United States Patent [19]

Osip et al.

[11] Patent Number: 5,042,226

[45] Date of Patent: Aug. 27, 1991

[54] METHOD OF SEALING A PLASTIC CONTAINER

[75] Inventors: Thomas W. Osip, Worthington, Ohio; Jerold W. Montgomery, Libertyville, Ill.; Paul A. Pezzoli, Worthington, Ohio

[73] Assignee: Abbott Labs., Abbott Park, Ill.

[21] Appl. No.: 587,204

[22] Filed: Sep. 24, 1990

Related U.S. Application Data

[62] Division of Ser. No. 388,889, Aug. 3, 1989, Pat. No. 5,004,110.

[51] Int. Cl.[5] ..... B65B 7/28; B65B 61/18

[52] U.S. Cl. ..... 53/412; 53/420; 53/478; 53/490

[58] Field of Search ..... 53/287, 411, 412, 416, 53/420, 478, 485, 490, DIG. 2; 156/69; 215/255, 341, 347, 350

[56] References Cited

U.S. PATENT DOCUMENTS

| | | | |
|---|---|---|---|
| 2,387,439 | 10/1945 | Grabus, Jr. et al. | 53/420 |
| 3,815,314 | 6/1974 | Pollack et al. | 53/420 |
| 4,666,052 | 5/1987 | Ou-Yang | 215/347 X |
| 4,719,740 | 1/1988 | Gach | 53/478 X |
| 4,818,577 | 4/1989 | Ou-Yang | 215/348 X |
| 4,846,361 | 7/1989 | Haffner | 53/490 X |
| 4,852,754 | 8/1989 | Holdsworth et al. | 215/347 |
| 4,946,038 | 8/1990 | Eaton | 53/412 X |

*Primary Examiner*—John Sipos

*Attorney, Agent, or Firm*—D. O. Nickey; L. R. Drayer; E. H. Gorman, Jr.

[57] ABSTRACT

There is disclosed a closure which permits the opening of a membrane sealed nutritional or pharmaceutical product container in a single action motion which also maintains a hermetic seal under retort conditions. This closure includes a generally cylindrical side wall having threads along the inner surface thereof and retaining means for cooperative engagement with the lip of a plastic container, and a top having an annular rim portion and a center portion, with the top having a lower surface attached to a heat-sealable barrier able to be secured to the plastic container, with the top also having a center portion removal means. A method is also disclosed for providing a hermetic seal on plastic containers using the closure and plastic container of this invention.

2 Claims, 4 Drawing Sheets

FIG. 3
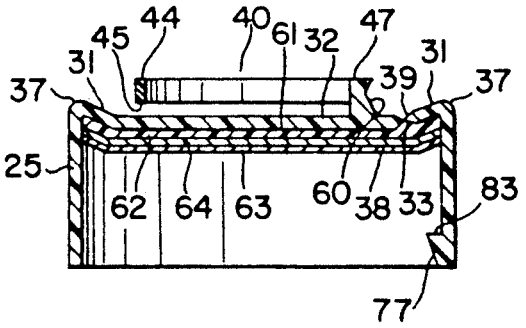
FIG. 4
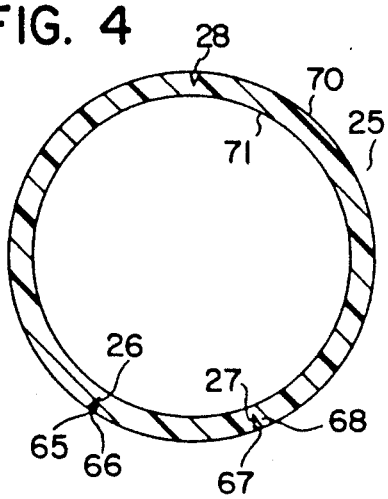
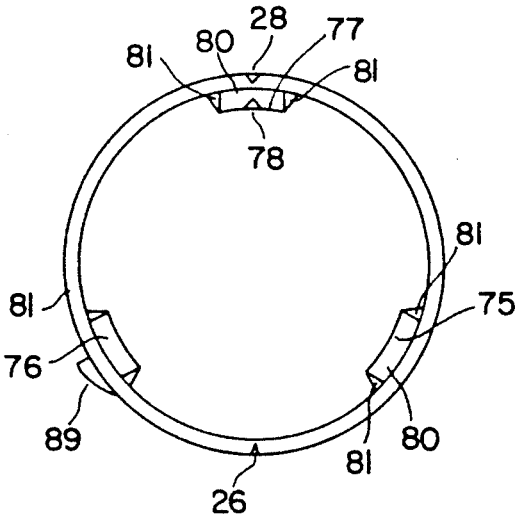
FIG. 5
FIG. 6
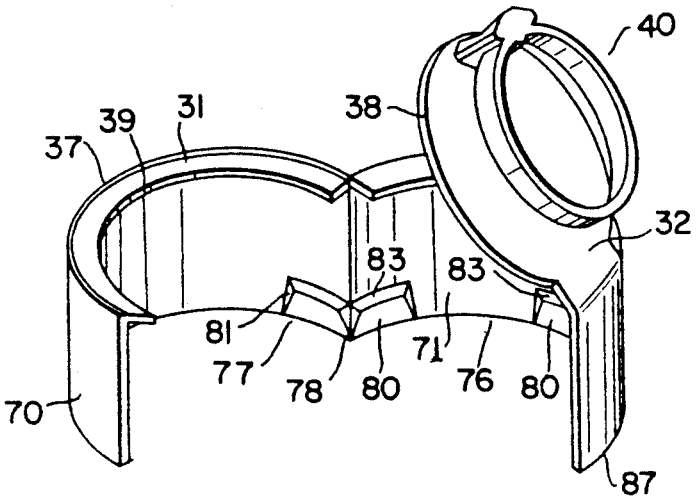

METHOD OF SEALING A PLASTIC CONTAINER

This is a divisional of application Ser. No. 388,889, filed on Aug. 3, 1989, now U.S. Pat. No. 5,004,110.

TECHNICAL FIELD

The present invention relates generally to a closure for a plastic container, and more particularly, to a plastic closure which permits the maintaining of a hermetic seal while providing easy removal of the seal from a plastic pediatric nutritional food, adult nutritional food, or pharmaceutical product container.

BACKGROUND ART

To ensure proper nutritional support for newborn infants, many doctors and hospitals recommend the use of liquid pediatric nutritional products. Pediatric nutritional products are utilized when breast feeding is not possible for either medical and/or social reasons. Furthermore, even in cases where breast feeding is possible, some mothers prefer the convenience afforded by the use of pediatric nutritional products.

In response to the need for pediatric nutritional products, water, soy and milk-based liquid foods have been developed for bottle feeding in conjunction with a rubber or latex nipple. Since the containers for these products often provide a twelve to eighteen month shelf life, a hermetic seal must be provided across the top of the container. A hermetic seal is one which when in place is impervious to microbiological intrusion and external influence. Presently, the industry provides of the hermetic seals through the use of a glass container, to which is secured by vacuum closure a stamped steel cap having a pre-cut rubber or vinyl plastisol gasket. The container is then subjected to temperatures above the ambient air temperature, and more specifically to retort conditions, whereby the hermetic seal must survive sterilization of the container. Since the glass container and the stamped-steel cap expand a similar amount and since a vacuum is present within the container, the hermetic seal is maintained during the sterilization process.

Due to concerns about material cost, container weight, and breakage, suppliers of pediatric nutritional products have sought to manufacture the nutritional product container from a polymeric substance, such as polypropylene, which is relatively clear, optically, and cost effective as compared to glass. A problem arises in attempting to provide a cap for a plastic container which maintains a hermetic seal during and subsequent to sterilization. Since conventional metal caps and plastics expand by a dissimilar amount, conventional metal caps do not provide a hermetic seal for plastic containers when subjected to retort conditions.

Another problem arises in that the application of heat under retort conditions causes polymer relaxation or shrinkage, especially in the upper neck portion of the container. Injection or extrusion molded bottles are formed by stretching the polymer molecules. The introduction of heat causes those molecules to relax, so as to actually shrink the diameter of the neck. This shrinkage causes additional problems in maintaining a conventional metal cap on a plastic bottle. This shrinkage also prevents the use of a conventional plastic cap on a plastic bottle.

One approach to the above two problems would be to apply a substantial amount of torque when initially capping the bottle, however the amount of torque necessary to maintain a conventional cap in place is so high that a person would not be able to easily twist off the cap following retort in order to feed an infant. Another possible approach would be to fabricate a bottle from a plastic which does not shrink at retort temperatures and can maintain an internal vacuum without distortion, however, the cost of providing such a bottle would be prohibitive.

Yet another possible approach to the providing of a hermetic seal would be to utilize a barrier membrane, such as aluminum foil, such that the integrity of the seal associated with a stamped-steel closure cap would no longer be important. This primary membrane seal would be protected from accidental or premature puncture by an overcap of a conventional design. One type of foil seal is the type which is peelable. However, in dealing with nutritional products subject to spoilage, peelable seals are not optimal for ensuring against spoilage and tamper prevention. Additionally, peelable foils also encounter difficulty surviving sterilization without encountering problems in their removal.

Therefore, a heat-fused metallic seal, which imparts a permanent seal, fused to the container utilizing with conventional membrane sealing technology is desirable. However the use of a heat-fused foil membrane necessitates that the outer cap be removed, followed by the piercing of the membrane seal. The piercing would normally be accomplished by a microbial laden device, such as a pair of scissors or a fingernail, thereby contaminating the pediatric nutritional product with bacteria from a non-sterilized tool or from the hands of a health care worker or parent.

Conventional laminate composites used in the art of heat-fused foil membrane feature a polyester/foil/ polypropylene laminate, with the polypropylene layer placed adjacent the plastic bottle, such that the polypropylene fuses to the bottle when subjected to sufficient heat. However, the polyester does not fuse against an adjacent surface. Thus, placement of a plastic cap over the conventional laminate will not result in the bonding of the polyester to the plastic cap, so that the cap can be used on the container and withstand retort conditions. It is thus apparent that a need exists for an improved closure for a pre-filled, membrane-sealed pediatric nutritional product container which provides system seal integrity, as well as permitting the opening of the nutritional products container in a single action motion. It is also apparent that the need exists for an improved closure for plastic containers which permits the container to survive retort conditions.

DISCLOSURE OF THE INVENTION

There is disclosed a closure for plastic containers having a annular lip, said closure comprising, a generally cylindrical side wall, said side wall having an outer surface and an inner surface, said closure having retaining means located adjacent said inner surface for cooperative engagement with said lip, and a top, said top having a center portion removal means, an annular rim portion and a center portion said top having a lower surface attached to a heat-sealable barrier, said heat sealable barrier able to be secured to said container and comparises an impervious layer between layers of a heat sealable material.

There is also disclosed in combination, a plastic container having a hermetic seal comprising, a plastic container having an annular lip, and a closure, said closure comprising, a generally cylindrical side wall, said side wall having an outer surface and an inner surface, said closure having retaining means located adjacent said inner surface for cooperative engagement with said lip, and a top, said top having an annular rim portion and a center portion, said top having a lower surface attached to a heat-sealable barrier, said heat-sealable barrier able to be secured to said container, said top having a center portion removal means. There is also disclosed a method for providing a seal for plastic containers, comprising, 1) placing a heat-sealable barrier across the top of a plastic container, said plastic container having an annular lip, said barrier comprising an air impervious layer between layers of polypropylene, 2) placing a closure over said heat-sealable barrier, said closure comprising a generally cylindrical side wall, said side wall having an outer surface and an inner surface, said closure having retaining means located adjacent said inner surface for cooperative engagement with said lip, and a top, said top having an annular rim portion and a center portion, said top having a lower surface attachable to the heat-sealable barrier and center portion removal means; 3) fusing the heat-sealable barrier to both the top and the container.

In one embodiment of the invention the center portion removal means comprises a ring in a ring base, said ring base secured to said center portion, while in another embodiment the center portion removal means comprises a pull tab having a chevron-shaped face.

Preferably the retaining means of the invention comprises a plurality of lugs. Additionally, a plurality of score lines are associated with the top and side walls of one embodiment, and with only the top of another embodiment.

The present invention provides a closure which maintains a hermetic seal when the container to which it is attached is subjected to retort conditions, and also allows an easy, singular-action removal of the seal without contaminating the nutritional or pharmaceutical product.

Yet another important aspect of this invention is to provide a simple method of fabrication of a plastic container having a hermetic, retortable closure.

Other aspects and advantages of the invention will be apparent from the following description, the accompanying drawings and appended claims.

BRIEF DESCRIPTION OF THE DRAWINGS

FIG. 3 is a vertical sectional view taken along line 3—3 of FIG. 2.

FIG. 4 is a horizontal sectional view taken along line 4—4 of FIG. 1.

FIG. 5 is a bottom plan view of the closure.

FIG. 6 is a perspective view showing the closure as it appears after the plastic container is opened.

DETAILED DESCRIPTION OF THE INVENTION

Figure 1:
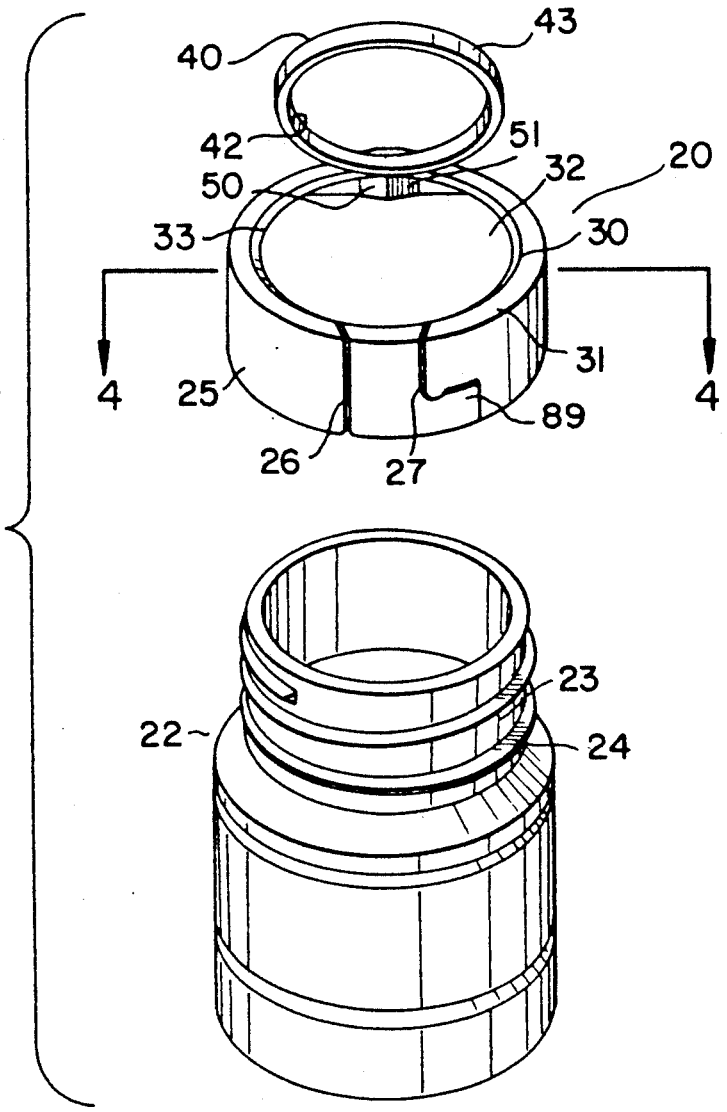
FIG. 1 is a perspective view of the closure in accordance with the present invention shown in conjunction with the plastic container with which it is used.

Having reference to the drawings, attention is directed first to FIG. 1, which illustrates a closure for a pediatric nutritional product container shown in conjunction with such a container, with the closure being designated by the numeral 20 and the plastic nutritional product container being designated by the numeral 22. Plastic container 22 has a threaded neck 23 and a lip 24.

Figure 2:
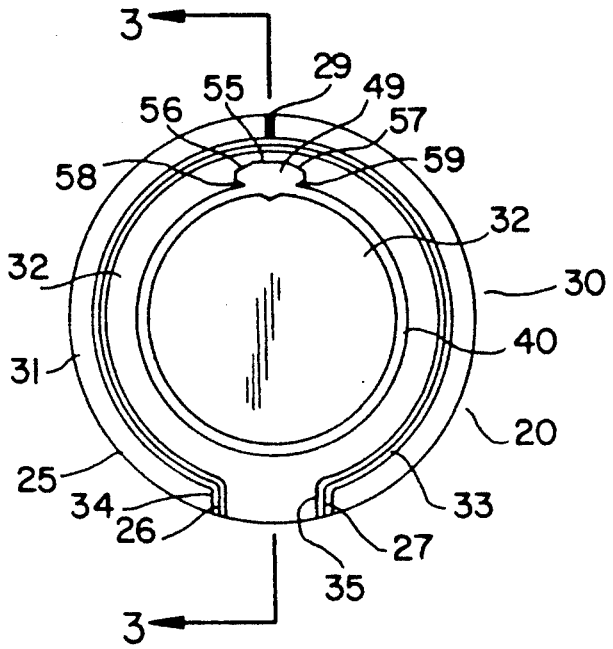
FIG. 2 is a top plan view of the closure.

As can be seen in FIGS. 1 and 2, the closure 20 of this invention comprises a side wall 25 having first score line 26, which extends from the top edge to the bottom edge of the side wall, second score line 27, and third score line 28, as well as a top 30. The top 30 has an annular rim portion 31 and a center portion 32 separated by a top score line 33. Additionally, as can be seen in FIGS. 1 and 2, a first rim score line 34 and a second rim score line 35 extend from the top score line 33 across annular rim portion 31 to the top edge 37 of side wall 25. As can be seen in FIGS. 2 and 3, the top score line 33 has a top score line first face 3B, as well as a second face 39.

As can be seen in FIGS. 1, 2 and 3, a center portion removal means in the form of a ring 40 is secured to the center portion 32 of top 30. The center portion removal means of this embodiment of the invention includes an inner ring wall 42, an outer ring wall 43, a top ring edge 44, and a bottom ring edge 45. The ring 40 is secured to a ringbase 47 having a unique configuration itself. The ring base 47 includes a base top surface 49 of a polygonal configuration. Additionally, the base has a pair of inner inclined walls 50 and 51 located adjacent inner ring wall 42. The ring base 47 also features a central outer wall 55 flanked by angled outer walls 56 and 57. Additionally, the ring base 47 has oppositely disposed base end walls 58 and 59 located between the inner inclined walls 50 and 51 and the angled outer walls 56 and 57 respectively. The central outer wall 55 and the angled outer walls 56 and 57 feature an area of depression 60.

The lower surface 61 of top 30 is capable of being fused to a polypropylene layer 62 of a heat-sealable barrier, with this barrier also including an air impervious layer 63 located between polypropylene layer 62 and polypropylene layer 64.

As can be seen in FIG. 4, the side wall 25 also has its first score line 26 configured to include a first score line first face 65 and a first score line second face 66, while second score line 27 includes a second score line first face 67 and a second score line second face 68. Both first and second score lines extend a substantial distance through side wall 25, with the extent of the indentation between outer surface 70 and inner surface 71 being greater for the first and second score lines as compared with the third score line 28.

As can be seen in FIGS. 3, 5 and 6, retaining means in the form of a first lug 75, second lug 76 and third lug 77 are provided adjacent to inner surface 71. The third lug 77 includes a lug score line 78 which cooperates with third score line 28 as discussed below. Each lug has a central face 80 and a pair of bevelled end faces B1. Additionally, each lug has a top surface 83.

FIGS. 1, 2, 3, and 5 disclose near the bottom edge 87 of side wall 25, the presence of a raised portion B9 which is shown at the bottom of the second score line 27. Consequently, the second score line extends from the top edge to the score line terminus 89 located between the top edge and the bottom edge. This score line terminus B9 prevents the closure from being only partly removed when the container is opened. When the container is opened, the closure appears as shown in FIG. 6.

Figure 7:
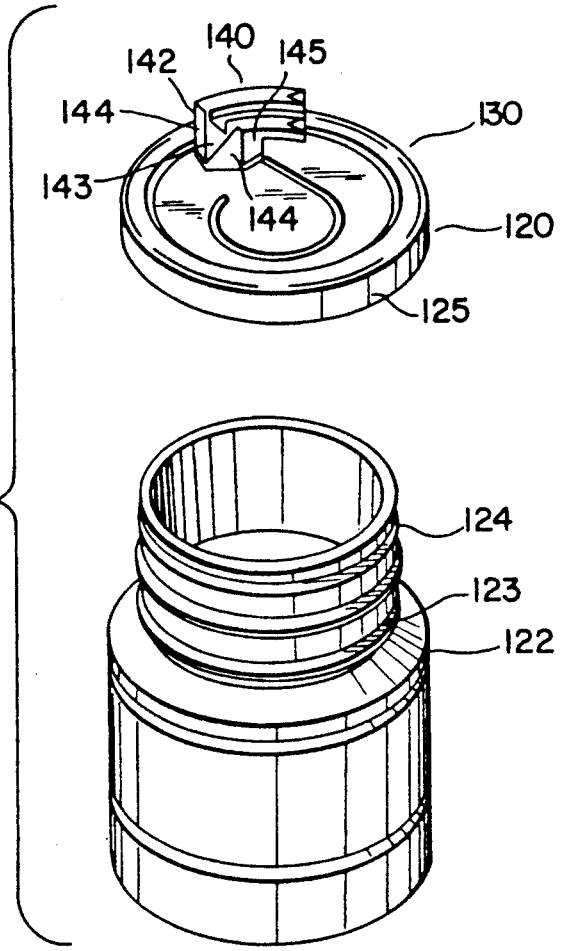
FIG. 7 is a modified embodiment of the invention showing a modified closure structure and modified bottle structure.

Although FIGS. 1 through 6 show one embodiment of the invention, what is believed to be the preferred embodiment of the invention is shown in FIGS. 7 through 12. Having reference to the drawings, attention is directed to FIG. 7 which illustrates a modified embodiment of both a plastic closure and a plastic container for use in conjunction with the closure, with the closure being designated by the numeral 120 and the container being designated by the numeral 122. The plastic container 122 has a threaded neck 123 and a lip 124, with the lip 124 being located on the plastic container 122 above the threaded neck portion 123. As can be seen in FIG. 7, the portion of the plastic container having lip 124 is of a lesser diameter than the remainder of the threaded neck portion 123.

Figure 8:
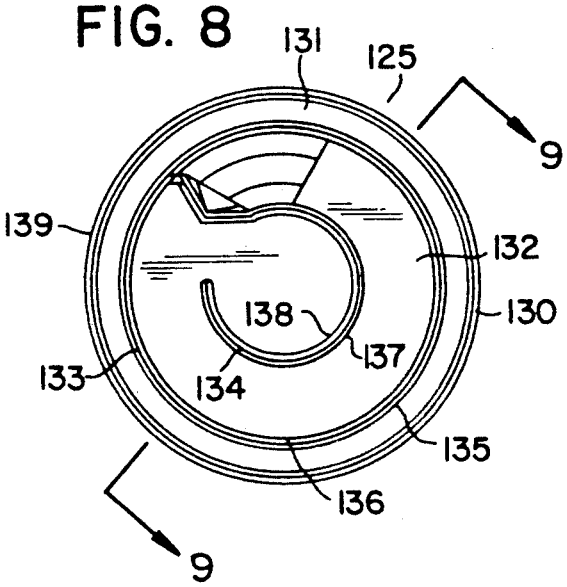
FIG. 8 is a top plan view of the modified structure.
Figure 9:
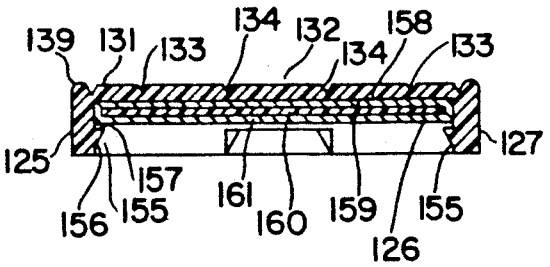
FIG. 9 is a vertical sectional view taken along line 9—9 of FIG. 8.

The modified closure 120 is shown in FIGS. 7, 8, and 9 as having a side wall 125, with the side wall 125 having an inner surface 126 and an outer surface 127. Additionally, the closure 120 has a top 130 having an annular rim portion 131 and a center portion 132. The innermost boundary of the annular rim portion 131 is an outer top score line 133, which serves to separate the annular rim portion from the center portion 132. An additional inner top score line 134 transverses the center portion 132 in a generally circular direction. The outer top score line includes first face 135 and second face 136, while the inner top score line includes first face 137 and second face 138.

Figure 10:
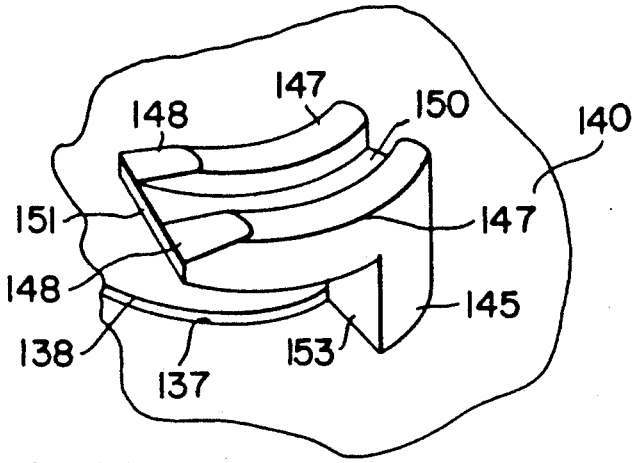
FIG. 10 is a perspective view taken from the rear side of FIG. 7 of the center portion removal means of the modified embodiment.

As can be seen in FIGS. 7 and 10, located inwardly from top edge 139 and annular rim portion 131 is center portion removal means 140, which in this embodiment is shown as being a pull tab having a chevron-shaped face 142. The chevron-shaped face 142 includes a center face 143 and side faces 144. Additionally, tab side walls 145 extend rearwardly from the chevron-shaped face 142, with a pair of ridges 147 having a tapered rear portion 148 extending along the top of the tab adjacent tab side walls 145. A planar top surface 150 lies between ridges 147 and extends from the chevron-shaped face 142 to the top surface rear face 151 of center portion removal means 140. The tab means 140 also includes a planar rear face 153.

Figure 11:
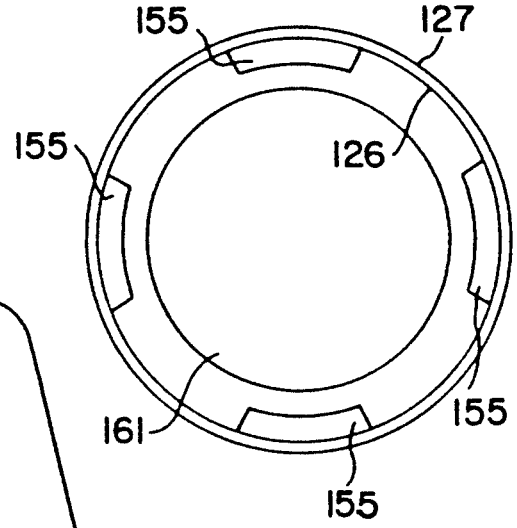
FIG. 11 is a bottom plan view of the modified embodiment.
Figure 12:
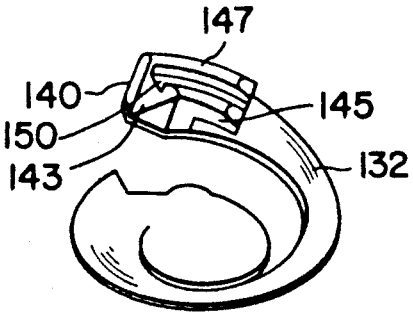
FIG. 12 is a perspective view of the closure and bottle of the modified embodiment, following removal of the center portion from the closure.
Figure 12:
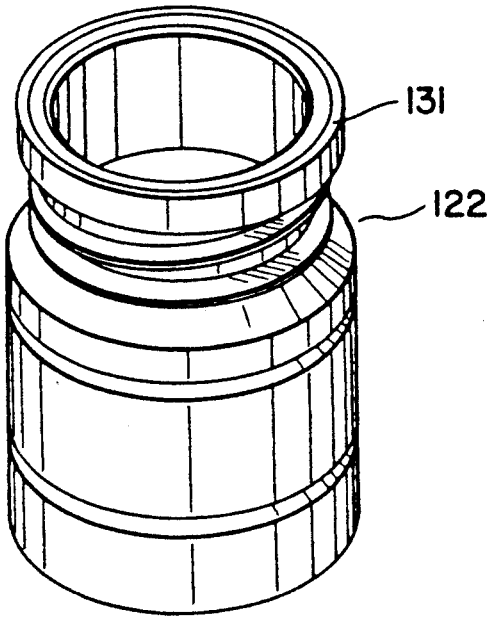

As can be seen in FIGS. 9 and 11, retaining means in the form of a plurality of lugs 155 extend inwardly from inner surface 126. The lugs have a bevelled face 156 and a lug top surface 157 with the lower most portion of the bevelled face 156 intersecting the inner wall 126 near the bottom edge of side wall 125.

As can be seen in FIG. 9, the lower surface 158 of top 130 is located adjacent a polypropylene layer 159. Directly adjacent polypropylene layer 159 is an air impervious membrane 160, with the lower surface of that air impervious membrane 160 being covered by yet another polypropylene layer 161. The air impervious layer 160 may be fabricated from either a metallic foil or an air impervious polymeric material such as polyvinylidene chloride. The polymeric film 159, 161 may be laminated or extrusion coated to the air impervious layer 160.

BEST MODE

In actual operation, the heat sealable barrier is placed inside the closure. The closure of this invention is placed over a container preferably fabricated from polypropylene, until the retaining means extends below the annular lip of the plastic container, at which point cooperative engagement occurs, which physically restricts the removal of the closure from the container. The type of closure selected depends on the configuration of the associated plastic container. More importantly, a downward force is applied when cooperative engagement occurs, with respect to the heat-sealable barrier, such that when the closure is subjected to a source of electromagnetic energy induced by an induction coil, the electromagnetic current is of sufficient strength so as to heat the metallic layer and cause the polypropylene layers on opposite sides there of to melt and fuse with the lower surface of the top, as well as with the threaded neck portion of the container. This fusing forms a hermetic seal, which is capable of surviving retort conditions up to 135° C.

To open the respective containers associated with the embodiments of this invention, an individual grasps the center portion removal means and pulls. The ring and base, or the tab with its chevron-shaped face cooperate to puncture the thin layers of polypropylene associated with the score lines on the top, as well as the air impervious membrane, such that the center portion removal means can be used to remove the center portion from the annular rim portion along most (in one embodiment) or all (in the preferred embodiment) of the top.

In the one embodiment, the plastic closure rips across the annular rim score lines and the first and second score lines, with the tearing along the first score line causing a discontinuity in the side wall of the closure. Continued pulling causes bending along the third score line shown in FIG. 6, such that the closure may easily be removed from the now open plastic container which is also now devoid of a hermetic seal.

In the preferred embodiment of the invention, the continued pulling on the tab means removes the center portion from the top of the closure. The closure, having been engaged over a lip which is recessed with respect to the diameter of the rest of the neck of the container, not only forms a pourable opening, but also provides for the attachment of an object such as a nipple ring without the necessity of removing the annular rim portion from the container.

The closure of this invention is preferably fabricated of polypropylene, a propylene copolymer or blends of polypropylene with other polymers. Additionally, the air impervious membrane, if foil, is approximately 0.025 millimeters thick, while the thickness of the polypropylene layers associated with the heat-sealable barrier is approximately 0.025+0.050 millimeters.

Thus, the potential for problems in preserving the hermetic seal and surviving retort conditions is precluded by the invention of the closure in combination with the plastic container having an annular lip. Further, the closure permits the opening of the container in a single-action motion, since once the center portion removal means is pulled, the container is left in a pourable condition without any subsequent opening procedures, such as could involve the use of a finger or tool to open a membrane seal.

INDUSTRIAL APPLICABILITY

Annually, approximately 200,000,000 units of pediatric nutritional products are distributed in the U.S., with a majority of these units utilizing glass containers and stamped-steel metal caps. The industry has long sought ways to eliminate the glass containers and move to a less expensive cap as well. This invention solves this long sought need. While this invention can be used on all plastic containers which do not require resealing of the container, it is specifically designed for plastic containers that are filled with a product and sterilized at temperatures exceeding 71° C., and more specifically for plastic containers which are sterilized at temperatures exceeding 100° C. Additionally, there are other applications for such a device outside the pediatric nutritional area such as adult nutritional foods or pharmaceutical product containers configured substantially as described above.

While the form of apparatus and method herein described constitute a preferred embodiment of this invention, it is to be understood that the invention is not limited to this precise form of apparatus or method and that changes may be made therein without departing from the scope of the invention which is defined in the appended claims.

What is claimed is:

1. A method of sealing a plastic container comprising the steps of:

a. placing a heat sealable barrier between the top of a plastic container and a plastic closure, said plastic container having an annular top, said closure comprising a generally cylindrical side wall, said side wall having an outer surface and an inner surface, said closure having retaining means located adjacent said inner surface for cooperative engagement with said container, and a top having an annular rim portion and a center portion, said top having a lower surface and a center portion removal means, said barrier being placed between the lower surface of the top of the closure and the annular top of the container and comprising an air impervious metallic layer disposed between and adjacent to layers of polypropylene film;

b. applying a force to cause cooperative engagement between the bottom surface of the closure and one of the layers of polypropylene film and between the other layer of polypropylene film and the container and to engage said closure retaining means with the container to permanently prevent removal of said closure from said container; and c. while maintaining said engagement subjecting the container, barrier and closure to a source of electromagnetic energy induced by an induction coil of sufficient strength that the metallic layer is heated, and causing the layers of polypropylene film to permanently fuse said closure and said container in a fixed relationship with respect to one another with the opening of the container occuring by removal of the closure center portion while leaving the closure annular rim permanently fused to the container.

2. The method of claim 1 wherein said container contains a nutritional or pharmaceutical product.

* * * * *

UNITED STATES PATENT AND TRADEMARK OFFICE

CERTIFICATE OF CORRECTION

PATENT NO. : 5,042,226

DATED : August 27, 1991

INVENTOR(S) : Thomas W. Osip, Jerold W. Montgomery and Paul A. Pezzoli

It is certified that error appears in the above-identified patent and that said Letters Patent is hereby corrected as shown below:

| | | | | | |
|---|---|---|---|---|---|
| Column 4, | Line | 27 | "3B" | to | --38-- |
| Column 4, | Line | 67 | "B1" | to | --81-- |
| Column 5, | Line | 2 | "B9" | to | --89-- |
| Column 5, | Line | 7 | "B9" | to | --89-- |

Signed and Sealed this

Fifth Day of January, 1993

*Attest:*

DOUGLAS B. COMER

*Attesting Officer*

*Acting Commissioner of Patents and Trademarks*